US009664130B2

(12) United States Patent
Wilcutts et al.

(10) Patent No.: US 9,664,130 B2
(45) Date of Patent: May 30, 2017

(54) USING CYLINDER FIRING HISTORY FOR COMBUSTION CONTROL IN A SKIP FIRE ENGINE

(71) Applicant: Tula Technology, Inc., San Jose, CA (US)

(72) Inventors: Mark A. Wilcutts, Berkeley, CA (US); Xin Yuan, Palo Alto, CA (US); Joshua P. Switkes, Menlo Park, CA (US); Li-Chun Chien, Santa Clara, CA (US); Steven E. Carlson, Oakland, CA (US); Christopher W. Chandler, Campbell, CA (US); Christopher C. Hand, San Jose, CA (US); Matthew A. Younkins, San Jose, CA (US); Adya S. Tripathi, San Jose, CA (US)

(73) Assignee: Tula Technology, Inc., San Jose, CA (US)

( * ) Notice: Subject to any disclaimer, the term of this patent is extended or adjusted under 35 U.S.C. 154(b) by 320 days.

(21) Appl. No.: 13/843,567

(22) Filed: Mar. 15, 2013

(65) Prior Publication Data

US 2014/0278007 A1 Sep. 18, 2014
US 2016/0377007 A9 Dec. 29, 2016

Related U.S. Application Data

(63) Continuation-in-part of application No. 13/004,844, filed on Jan. 11, 2011, now Pat. No. 8,701,628, which
(Continued)

(51) Int. Cl.
*F02D 41/00* (2006.01)
*F02D 41/30* (2006.01)

(52) U.S. Cl.
CPC ..... *F02D 41/0087* (2013.01); *F02D 41/3058* (2013.01); *F02D 2200/0614* (2013.01)

(58) Field of Classification Search
CPC ..... F02D 41/0087; F02D 17/02; F02D 37/02; F02D 13/06; F02D 2041/001; F02D 2250/18; F02D 2250/21; F02D 41/0082; F02D 13/0219; F02D 19/061; F02D 19/081; F02D 41/0085; F02D 41/086; F02D 41/1475; F02D 41/1495; F02D 41/182;
(Continued)

(56) References Cited

U.S. PATENT DOCUMENTS 4,100,891 A 7/1978 Williams
4,388,906 A 6/1983 Sugiyama et al.
(Continued)

OTHER PUBLICATIONS

Tripathi et al., U.S. Appl. No. 15/401,516, filed Jan. 9, 2017.

*Primary Examiner* — Hung Q Nguyen
*Assistant Examiner* — John Bailey
(74) *Attorney, Agent, or Firm* — Beyer Law Group LLP

(57) ABSTRACT

Various methods and arrangements for determining a combustion control parameter for a working chamber in an engine are described. In one aspect, an engine controller includes a firing counter that stores a firing history for the working chamber. A combustion control module is used to determine a combustion control parameter, which is used to help manage combustion in the working chamber. The combustion control parameter is determined based at least in part on the firing history.

28 Claims, 5 Drawing Sheets

Related U.S. Application Data is a continuation-in-part of application No. 12/501,345, filed on Jul. 10, 2009, now Pat. No. 8,336,521, which is a continuation-in-part of application No. 12/355,725, filed on Jan. 16, 2009, now Pat. No. 8,131,447.

(60) Provisional application No. 61/080,192, filed on Jul. 11, 2008, provisional application No. 61/104,222, filed on Oct. 9, 2008, provisional application No. 61/294,077, filed on Jan. 11, 2010.

(58) Field of Classification Search
CPC ... F02D 41/3064; Y02T 10/123; F02P 5/1512
USPC ..... 123/406.11, 198 F, 406.47, 481, 609; 701/103, 101, 105; 60/285
See application file for complete search history.

(56) References Cited

U.S. PATENT DOCUMENTS 4,434,767 A 3/1984 Kohama et al.
4,489,695 A 12/1984 Kohama et al.
4,509,488 A 4/1985 Forster et al.
4,528,960 A 7/1985 Mizuno et al.
4,530,332 A 7/1985 Harvey et al.
4,590,907 A 5/1986 Tsukamoto et al.
4,849,744 A * 7/1989 Putrow ..... G09G 1/162 324/378
5,058,021 A * 10/1991 Scott ..... F02P 3/0456 123/406.35
5,058,550 A 10/1991 Nagano et al.
5,377,631 A 1/1995 Schechter
5,404,857 A 4/1995 Schommers
5,464,000 A 11/1995 Pursifull et al.
5,636,609 A 6/1997 Fujiyoshi
5,642,722 A 7/1997 Schumacher et al.
5,669,357 A 9/1997 Denz et al.
5,692,471 A 12/1997 Zhang
5,720,257 A 2/1998 Motose et al.
5,769,054 A 6/1998 Schnaibel et al.
5,803,040 A * 9/1998 Biesinger ..... F01L 13/0036 123/198 F
5,819,714 A 10/1998 Bush et al.
5,947,095 A 9/1999 Kato
6,158,411 A 12/2000 Morikawa
6,571,771 B2 6/2003 Doering et al.
6,619,258 B2 9/2003 McKay et al.
7,063,062 B2 6/2006 Lewis et al.
7,066,136 B2 * 6/2006 Ogiso ..... F02D 13/06 123/198 F
7,086,386 B2 8/2006 Doering
7,111,593 B2 9/2006 Song et al.
7,503,312 B2 * 3/2009 Surnilla ..... F02D 41/0082 123/198 F
7,577,511 B1 8/2009 Tripathi et al.
7,849,835 B2 12/2010 Tripathi et al.
7,886,715 B2 2/2011 Tripathi et al.
7,930,087 B2 4/2011 Gibson et al.
7,941,994 B2 * 5/2011 Surnilla ..... F02D 41/0087 123/198 F
7,954,474 B2 6/2011 Tripathi et al.
8,052,575 B2 11/2011 Albertson et al.
8,099,224 B2 1/2012 Tripathi et al.
8,131,445 B2 3/2012 Tripathi et al.
8,145,410 B2 3/2012 Berger et al.
8,336,521 B2 12/2012 Tripathi et al.
8,651,091 B2 2/2014 Tripathi et al.
9,086,020 B2 7/2015 Tripathi et al.
9,200,587 B2 12/2015 Serrano
9,528,446 B2 12/2016 Pirjaberi et al.
2003/0220732 A1 11/2003 Matthews et al.
2003/0221655 A1 * 12/2003 Surnilla ..... F01N 3/0814 123/198 F
2004/0237514 A1 * 12/2004 Surnilla ..... F01N 13/011 60/299
2005/0193720 A1 * 9/2005 Surnilla ..... F02D 41/0082 60/285
2005/0193980 A1 * 9/2005 Doering ..... F01N 3/0814 123/406.47
2005/0197759 A1 * 9/2005 Surnilla ..... F02P 5/1504 701/103
2005/0197761 A1 * 9/2005 Bidner ..... F02P 5/045 701/105
2007/0162215 A1 7/2007 Dietl et al.
2008/0066450 A1 3/2008 Surnilla et al.
2008/0127933 A1 * 6/2008 Blumberg ..... F02B 11/00 123/304
2008/0154468 A1 6/2008 Berger et al.
2008/0262712 A1 10/2008 Duty et al.
2009/0099755 A1 * 4/2009 Harbert ..... F02D 41/0087 701/103
2010/0050985 A1 * 3/2010 Tripathi ..... F02D 41/0087 123/406.23
2010/0050993 A1 3/2010 Zhao et al.
2011/0030657 A1 * 2/2011 Tripathi ..... F02D 17/02 123/481
2011/0208405 A1 * 8/2011 Tripathi ..... F02D 17/02 701/102
2011/0213540 A1 * 9/2011 Tripathi ..... F02D 37/02 701/102
2011/0251773 A1 10/2011 Sahandiesfanjani et al.
2012/0109495 A1 * 5/2012 Tripathi ..... F02D 41/30 701/102
2012/0143471 A1 * 6/2012 Tripathi ..... F02D 28/00 701/102
2013/0066502 A1 3/2013 Yuille et al.
2013/0298870 A1 * 11/2013 Tripathi ..... F02D 17/02 123/406.12
2014/0000555 A1 * 1/2014 Glugla ..... F02D 41/008 123/305
2014/0053805 A1 * 2/2014 Brennan ..... F02D 41/0087 123/350
2014/0069178 A1 * 3/2014 Beikmann ..... G01L 23/22 73/114.07
2014/0069377 A1 * 3/2014 Brennan ..... F02D 41/0002 123/350
2014/0251282 A1 * 9/2014 Kotwicki ..... F02D 41/18 123/481
2015/0100221 A1 * 4/2015 Routledge ..... F02D 17/02 701/111

* cited by examiner

USING CYLINDER FIRING HISTORY FOR COMBUSTION CONTROL IN A SKIP FIRE ENGINE

This application is a Continuation-in-Part of U.S. patent application Ser. No. 13/004,844, now U.S. Pat. No. 8,701,628, filed on Jan. 11, 2011, which is a Continuation-in-Part of U.S. patent application Ser. No. 12/501,345, now U.S. Pat. No. 8,336,521, filed Jul. 10, 2009. U.S. patent application Ser. No. 12/501,345 is a Continuation-in-Part of U.S. patent application Ser. No. 12/355,725, now U.S. Pat. No. 8,131,447, filed Jan. 16, 2009. U.S. patent application Ser. No. 12/355,725 claims the priority of U.S. Provisional Patent Application No. 61/080,192, filed Jul. 11, 2008; and 61/104,222, filed Oct. 9, 2008. U.S. patent application Ser. No. 13/004,844 also claims priority of Provisional Application No. 61/294,077 filed Jan. 11, 2010.

FIELD OF THE INVENTION

The present invention relates generally to skip fire engine control. Various embodiments involve using a firing history of a working chamber to help determine a combustion control parameter, such as fuel compensation, air/fuel charge and/or spark timing.

BACKGROUND

There are a wide variety of internal combustion engines in common usage today. Most internal combustion engines utilize reciprocating pistons with two or four-stroke working cycles and operate at efficiencies that are well below their theoretical peak efficiency. One of the reasons that the efficiency of such engines is so low is that the engine must be able to operate under a wide variety of different loads. Accordingly, the amount of air and fuel that is delivered into each cylinder typically varies depending upon the desired torque or power output. For throttled engines it is well understood that the cylinders are more efficient when they are operated under specific conditions that permit full or near-full load and optimal fuel injection levels that are tailored to the cylinder size and operating conditions. Generally, the best thermodynamic efficiency of an engine is found when the air delivery to the cylinders is unthrottled. However, in engines that control the power output by using a throttle to regulate the flow of air into the cylinders (e.g., Otto cycle engines used in many passenger cars), operating at an unthrottled position (i.e., at "full throttle") would typically result in the delivery of more power (and often far more power) than desired or appropriate.

Over the years there have been a wide variety of efforts made to improve the thermodynamic efficiency of internal combustion engines. One approach that has gained popularity is to vary the displacement of the engine. Most commercially available variable displacement engines effectively "shut down" some of the cylinders during certain low-load operating conditions. When a cylinder is "shut down", its piston still reciprocates, however neither air nor fuel is delivered to the cylinder so the piston does not deliver any power during its power stroke. Since the cylinders that are shut down don't deliver any power, the proportionate load on the remaining cylinders is increased, thereby allowing the remaining cylinders to operate at an improved thermodynamic efficiency. The improved thermodynamic efficiency results in improved fuel efficiency.

Another engine control approach is often referred to as "skip fire" control of the engine. In conventional skip fire control, fuel is not delivered to selected cylinders based on some designated control algorithm. Over the years, a number of skip fire engine control arrangements have been proposed, however, most still contemplate throttling the engine or modulating the amount of fuel delivered to the cylinders in order to control the engine's power output.

The assignee of the present application has filed a variety of applications that involve skip fire control. For example, U.S. Pat. No. 8,131,447 describes skip fire control implementations that do not require substantial throttling. As a result, various described embodiments allow for the firing of working chambers at near optimal conditions, thereby improving fuel efficiency.

SUMMARY OF THE INVENTION

Various methods and arrangements for improving combustion control for a working chamber in an engine are described. In one aspect, an engine controller includes a firing counter or recorder that stores a firing history for each working chamber. A combustion control module is used to help determine a combustion control parameter, which is involved in managing combustion in the working chamber. The determination of the combustion control parameter is based at least in part on the firing history. The stored firing history may take a wide variety of forms, depending of the needs of a particular application. In various embodiments, for example, the firing history may indicate whether the working chamber was fired or skipped and/or the conditions under which it was fired or skipped. For example, the conditions that may be saved relating to the firings may include the cylinder air and fuel charge as well as spark timing, cam phasing, etc. For the skips, the information saved may relate to the type of deactivation for the skips. The firing history may be used to help determine a wide variety of combustion control parameters, such as spark advance, injection timing, injection pulse width, fuel pressure, ignition dwell time, valve lift, cam phasing, etc. The use of firing history in this manner is particularly useful in skip fire applications.

Various embodiments contemplate storing the individual firing histories of some or all of the available working chambers to help calculate a distinct level of fuel compensation for each working chamber. The calculation of the combustion control parameter for a working chamber may take into account other variables and inputs other than the firing history of the working chamber, including but not limited to engine temperature, manifold absolute pressure, air charge and/or the firing histories of other working chambers in the engine. In some implementations, the history of injection and intake events for a working chamber is used in a modified fuel port deposition and decay rate model in port injection engines.

BRIEF DESCRIPTION OF THE DRAWINGS

The invention and the advantages thereof, may best be understood by reference to the following description taken in conjunction with the accompanying drawings in which.

In the drawings, like reference numerals are sometimes used to designate like structural elements. It should also be appreciated that the depictions in the figures are diagrammatic and not to scale.

DETAILED DESCRIPTION

Figure 1:
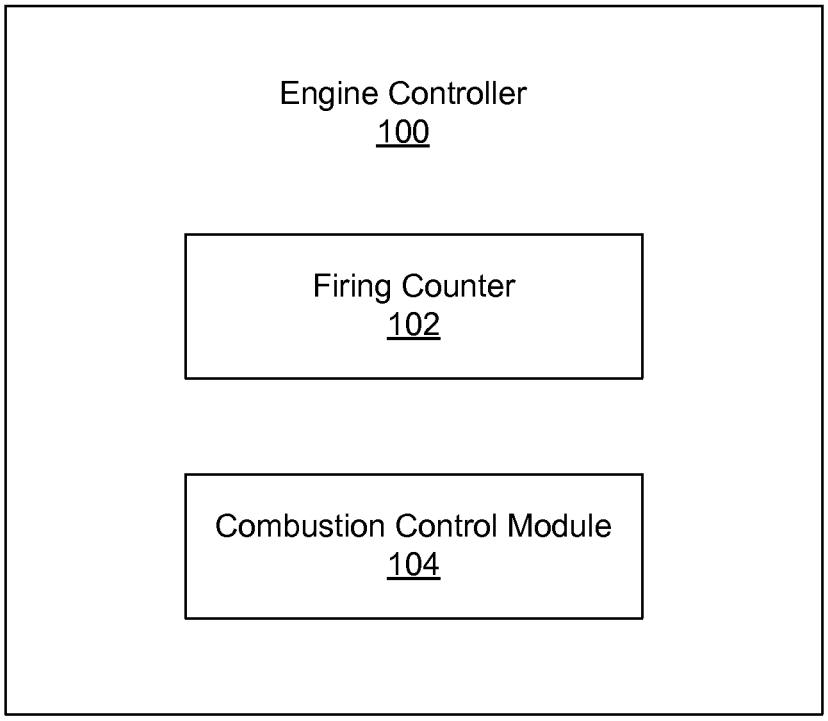
FIG. 1 is a block diagram of an engine controller with a combustion control module according to a particular embodiment of the present invention.

The present invention relates generally to mechanisms and arrangements for determining combustion control parameters, such as fuel delivery, ignition timing and spark advance. More specifically, the firing history of individual working chambers is used to improve estimates of one or more combustion control parameters.

A combustion control parameter is any parameter, setting or configuration that helps to manage combustion in the working chamber. For example, well known combustion control parameters include fuel compensation/delivery (e.g., the amount of fuel that is delivered to a working chamber or injected into a corresponding intake port), fuel injection timing, injection pulse width, fuel pressure, cam phase, valve lift and ignition dwell time. Calibration of the fuel pressure, fuel injection timing and injection pulse width can help control the amount of fuel that enters the working chamber. Cam phasing and valve lift adjustment affect the timing of the opening and closing of valves and thus affects the amount of air that is in the working chamber, as well as the residual combusted gas content. Spark timing and ignition dwell time relate to the timing and energy of the spark that is used to initiate combustion. If combustion control parameters are not set correctly, the air-fuel ratio or combustion in the working chamber may be suboptimal, which can reduce engine performance and/or increase the amount of undesirable pollutants generated by the working chamber.

The proper setting of combustion control parameters for a working chamber depends on having an accurate understanding of the temperature, residual gases and other conditions in the working chamber. These conditions are influenced by the firing history of the working chamber. For example, the firing or skipping/deactivation of a working chamber during a particular working cycle have different effects on these conditions. Generally, in a conventional non-skip fire engine, all of the working chambers are fired during every engine cycle. Thus, conventional techniques for determining combustion control parameters generally treat all of the working chambers the same since they have more or less the same history.

In skip fire engine approaches, however, the working chambers may have very different firing sequences and conditions. With skip fire engine control, selected working cycles of selected working chambers are fired or skipped to deliver a desired torque. Each working chamber may have a different, possibly irregular firing pattern e.g., it may be skipped at a first firing opportunity, be fired at the next opportunity, and then be skipped or fired at the very next opportunity. (The assignee of the present application has filed multiple applications involving skip fire engine operation, including U.S. Pat. Nos. 7,954,474; 7,886,715; 7,849,835; 7,577,511; 8,099,224; 8,131,445; and 8,131,447; U.S. patent application Ser. Nos. 13/004,839 and 13/004,844; and U.S. Provisional Patent Application Nos. 61/639,500; 61/672,144; 61/441,765; 61/682,065; 61/677,888; 61/683,553; 61/682,151; 61/682,553; 61/682,135; 61/682,168; 61/080,192; 61/104,222; and 61/640,646, each of which is incorporated herein by reference in its entirety for all purposes.) Since each working chamber may have a different firing history, each working chamber may have different features, such as different temperatures (e.g., of the cylinder wall, piston, gases, etc.) and amounts of exhaust or crankcase gases. Also, in port fuel injected engines, the amount of fuel lingering in the intake port of each cylinder will be different depending on how long ago was the most recent injection As a result, the determination of combustion control parameters can be improved if the firing history of the working chamber is taken into account.

Various implementations of the present invention address one or more of the above issues. Referring initially to FIG. 1, an engine controller 100 according to a particular embodiment of the present invention will be described. The engine controller 100 is arranged to operate an engine in a skip fire manner and uses the firing history of each working chamber to generate suitable combustion control parameters for the working chamber. (In some embodiments, the firing histories of one or more other working chambers are also used to help determine the combustion control parameters.) In the illustrated embodiment, the engine controller 100 includes a firing counter 102 and a combustion control module 104.

The firing counter 102 is arranged to determine or track a firing history for a particular working chamber. The firing history may be determined in a wide variety of ways. In some implementations, for example, the firing counter 102 counts the number of consecutive skips since the last fire. In still other embodiments, the firing counter 102 counts the number of skips and/or fires of the working chamber over a predetermined number of past, consecutive firing opportunities. The firing history data is stored and then sent to the combustion control module 104.

The combustion control module 104 is arranged to determine one or more combustion control parameters based on the firing history. Various implementations involve determining ignition timing, injection timing, ignition dwell time, injection pulse width and/or cam timing in this manner. The present invention, however, is not limited to these particular parameters, and the described embodiment may be used to generate any suitable combustion control parameter that helps improve combustion and working chamber performance. It should further be noted that the firing history may be used more generally to adjust any parameter that affects the operation of the working chamber.

Since skip fire engine control typically involves different firing sequences for different working chambers, the firing counter 102 generally is arranged to track a distinct firing history for each working chamber. The combustion control module 104 then independently calculates desired combustion control parameters for each working chamber based on its respective firing history. As a result, for example, if two working chambers have different firing sequences, the combustion control module may determine that the two working chambers should have different fuel charges or different spark timing, even during the same engine cycle.

Figure 2:
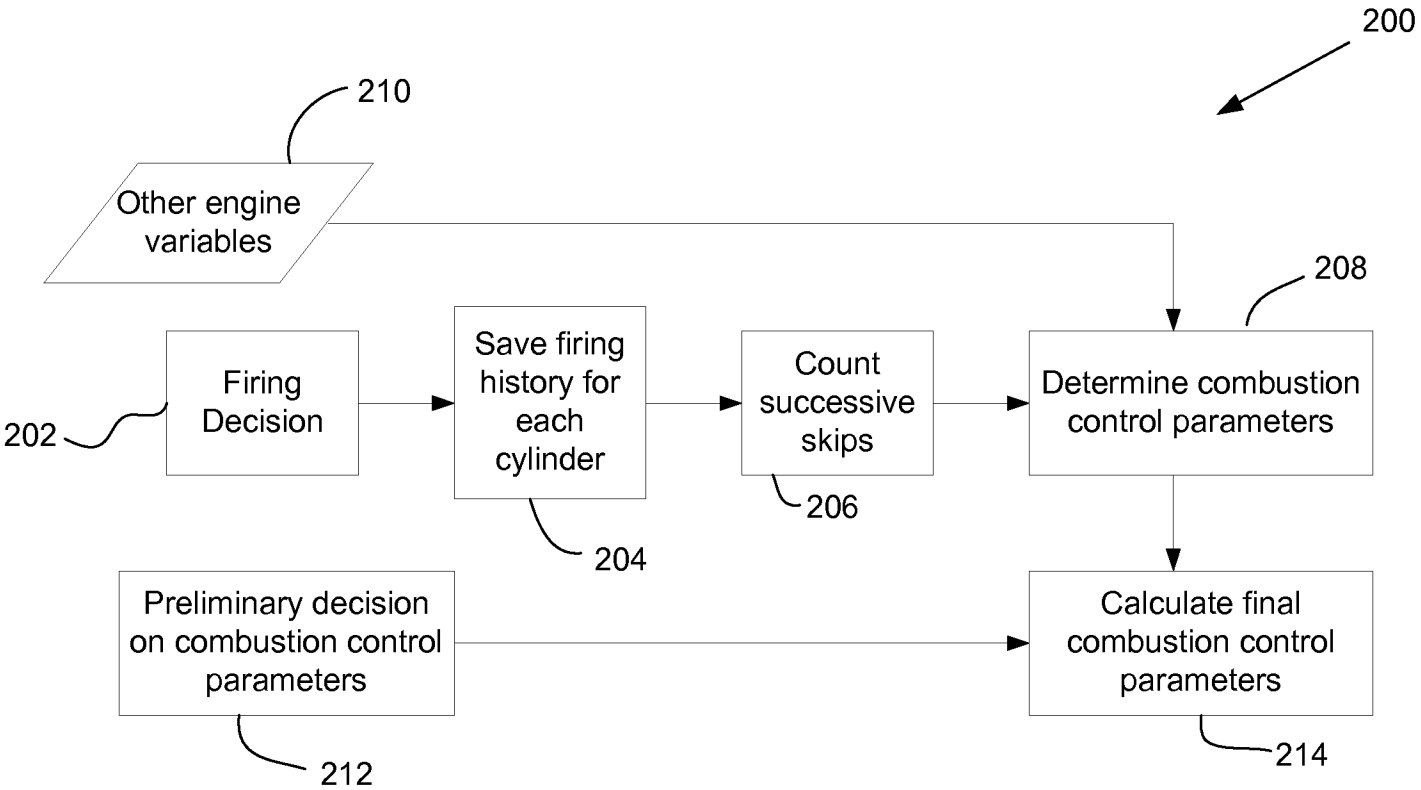
FIG. 2 is a flow diagram illustrating a method for determining combustion control parameters according to one embodiment of the present invention.

There are a wide variety of ways in which the engine controller 100 may determine a combustion control parameter. By way of example, FIGS. 2-5 describe various operations for calculating a combustion control parameter that may be performed by the engine controller 100, the firing counter 102 and/or the combustion control module 104. Referring next to FIG. 2, a flow diagram of a method 200 for determining a combustion control parameter according to one embodiment of the present invention will be described.

At step 202, one or more firing decisions are made for a particular working chamber. A firing decision generally involves a firing command indicating that the working chamber will be skipped or fired during a particular working cycle. The firing command is then used to orchestrate the actual operation of the associated working chamber. In some of the aforementioned co-assigned patent applications, there are references to engine controllers, engine control units or firing timing determination units that generate firing sequences or firing decisions. Any of these modules and functions may be integrated into the illustrated embodiment.

The firing decisions are then stored to form a firing history for the working chamber (step 204). Therefore, a distinct firing history is generated for each working chamber. At step 206, a number of skips is counted based on the firing history of each working chamber. In various implementations, this number is the number of skips that have taken place over a range of consecutive firing opportunities for the working chamber.

What is counted, how the firing history is represented or stored and/or the size of the range may vary widely, depending on the needs of a particular application. In some embodiments, for example, the firing commands are stored in a distinct vector for each working chamber, although any suitable data structure may also be used. In another embodiment, a counter may be used to count a number of skips, which resets after a fire has taken place or after a predetermined number of consecutive firing opportunities has passed. In other embodiments, the firing history for the working chamber is represented in a manner that does not require storing a number of skips or fires. An example of such a model is one whose output represents relevant states of the cylinder or a time history of the cylinder.

At step 208, the firing history is used to generate one or more combustion control modifiers (e.g., a spark timing modifier, a fuel mass modifier, an ignition timing or dwell modifier, etc.) for each working chamber. Each combustion control modifier is used to adjust a corresponding preliminary estimate for a combustion control parameter, which was determined using any suitable known technique (step 212). This adjustment results in the calculation of a set of final combustion control parameters (step 214) for the working chamber. The engine controller is then arranged to operate the working chamber in accordance with the final combustion control parameters. Accordingly, in an eight cylinder engine, it is possible for some or all of the cylinders to be operated with different fuel charges, ignition timings or other combustion control parameters due to their different firing histories.

In various embodiments, the combustion control modifier or parameter for a particular working chamber is based not only on the firing history of the working chamber, but also on other engine parameters (step 210), or estimated parameters. These parameters can include but are not limited to engine temperature, manifold pressure, air charge and cam position. Various implementations involve generating a combustion control parameter or modifier for a particular working chamber based not only on the firing history of that working chamber, but also on the firing histories of one or more other working chambers in the engine.

In the illustrated embodiment, a modifier and a preliminary estimate are separately generated for a particular working chamber and are then used together to determine a final value for a combustion control parameter. It should be appreciated, however, that any suitable technique may be used to generate the final combustion control parameter value based on the firing history of the working chamber. In some approaches, for example, a final value for the combustion control parameter is generated directly from the firing history and/or other engine variables and a separate modifier is not calculated.

Experiments confirm that the described embodiments can assist in setting improved combustion control parameters, thus resulting in greater engine efficiency and performance. Charts 1 and 2 describe the results of various experiments reduced to tables that may be implemented as compensation factors in the combustion control system.

CHART 1

Post-skip Fuel Compensation Table (Multiplier)

| | | Number of Skips | | | |
|---|---|---|---|---|---|
| | | 1 | 2 | 3 | 4 |
| RPM | 900 | A1 | A2 | A3 | A4 |
| | 1250 | A5 | A6 | A7 | A8 |
| | 1500 | A9 | A10 | A11 | A12 |
| | 1750 | A13 | A14 | A15 | A16 |
| | 2000 | A17 | A18 | A19 | A20 |
| | 2500 | A21 | A22 | A23 | A24 |
| | 3000 | A25 | A26 | A27 | A28 |

CHART 2

Post-Skip Spark Timing Compensation Table (Adder)

| | | Number of Skips | | | |
|---|---|---|---|---|---|
| | | 1 | 2 | 3 | 4 |
| RPM | 900 | B1 | B2 | B3 | B4 |
| | 1250 | B5 | B6 | B7 | B8 |
| | 1500 | B9 | B10 | B11 | B12 |
| | 1750 | B13 | B14 | B15 | B16 |
| | 2000 | B17 | B18 | B19 | B20 |
| | 2500 | B21 | B22 | B23 | B24 |
| | 3000 | B25 | B26 | B27 | B28 |

Chart 1 describes example fuel performance multipliers for a working chamber depending on engine speed (measured in RPM) and firing history (measured in the number of consecutive skips). Values A1-A28 were each found to be in the range of 0.9 to 1.1. Chart 2 describes example spark timing advance adjustments based on engine speed and firing history. Values B1-B28 were each found to be in the range of +/−10°. The adjustments resulted in superior engine performance in terms of air-fuel ratio control and torque optimization. It should be noted that the charts are provided only for illustrative purposes and that the present invention also contemplates a wide variety of implementations that may depart from the approach described in the above charts. In some embodiments, for example, the numbers of dimensions, the choice of inputs and/or the value ranges may be different.

Figure 3:
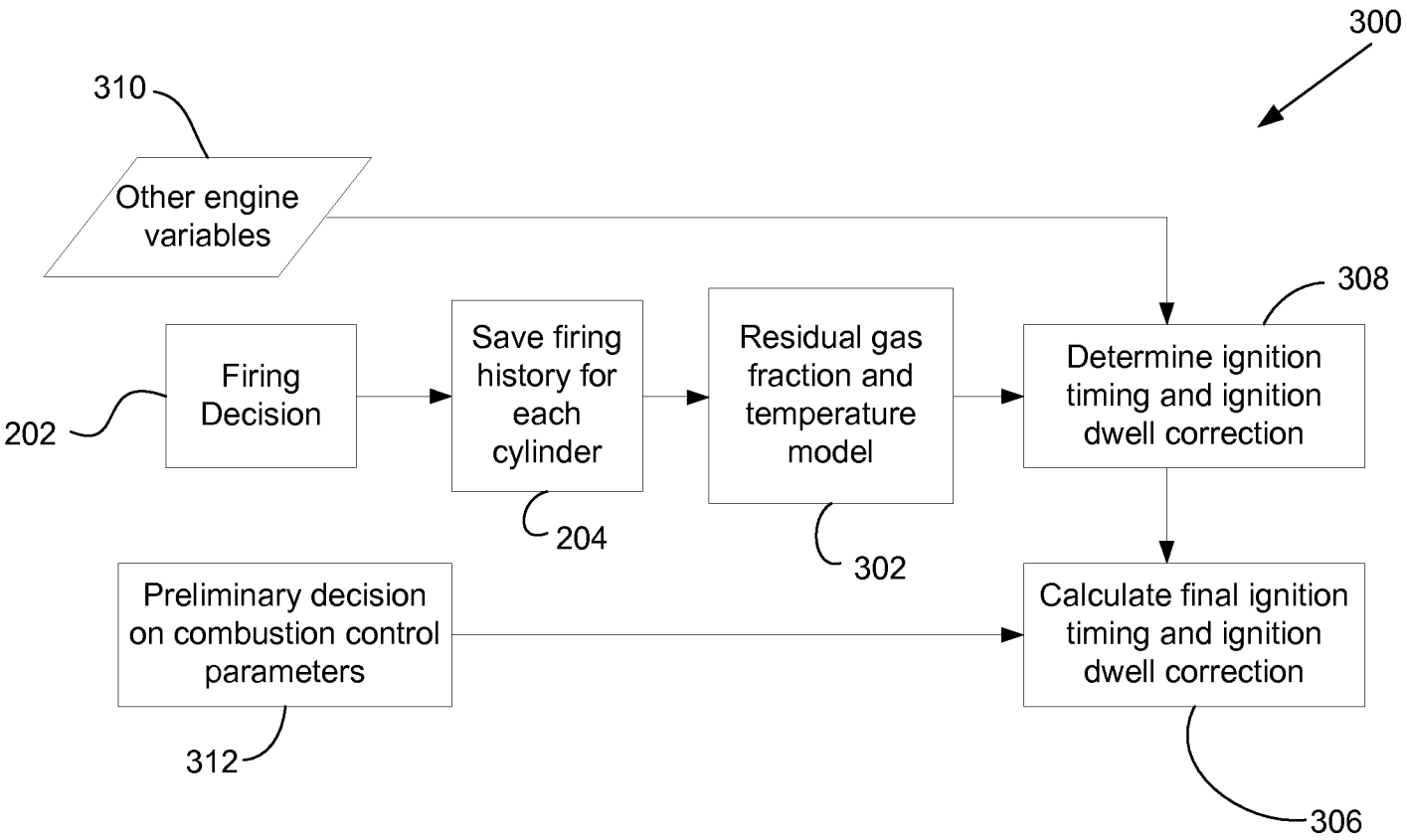
FIG. 3 is a flow diagram illustrating a method for determining ignition timing or dwell according to one embodiment of the present invention.

Referring next to FIG. 3, a flow diagram illustrating a method 300 for determining ignition timing and ignition dwell according to particular embodiment of the present invention will be described. FIG. 3 describes a more specific application of what is shown in FIG. 2. Some steps are similar or identical to what appears in FIG. 2, including steps 202 and 204. That is, in the illustrated embodiment, firing decisions are also saved for each working chamber in any suitable manner (e.g., by the counting of the number skips.) Similar to step 212 of FIG. 2, base values for ignition timing and ignition dwell are calculated for the working chamber using any suitable known technique (step 312). Similar to steps 208 and 210 and of FIG. 2, the correction of the base values may take into account a wide variety of engine variables other than the firing history, such as engine temperature, manifold pressure, air charge and cam position (steps 308 and 310.).

Method 300 involves using a residual gas fraction and temperature model (step 302) to determine the amount of correction required for the base ignition timing and ignition dwell estimates (step 304). The model takes into account the cooling/heating and residual gas effects of a skip on a working chamber. The model may take into account a wide variety of implementations and conditions. For example, in some approaches and depending on the sequencing of the closing/opening of the intake and exhaust values, exhaust gas may be trapped in a working chamber. For such approaches, the model may estimate that a skip of the working chamber causes heating. In other approaches and/or under different conditions, the model may estimate that cooling takes place as a result of a skip. Optionally, a wide variety of other engine variables (e.g., engine temperature, manifold pressure, air charge, cam position, etc.) are also taken into account by the model. At step 306, final values for the ignition timing and ignition dwell are calculated by applying the corrections determined in step 308 to the base estimates determined in step 312. The engine controller then orchestrates the ignition timing and ignition dwell for the working chamber based on the final values.

Figure 4:
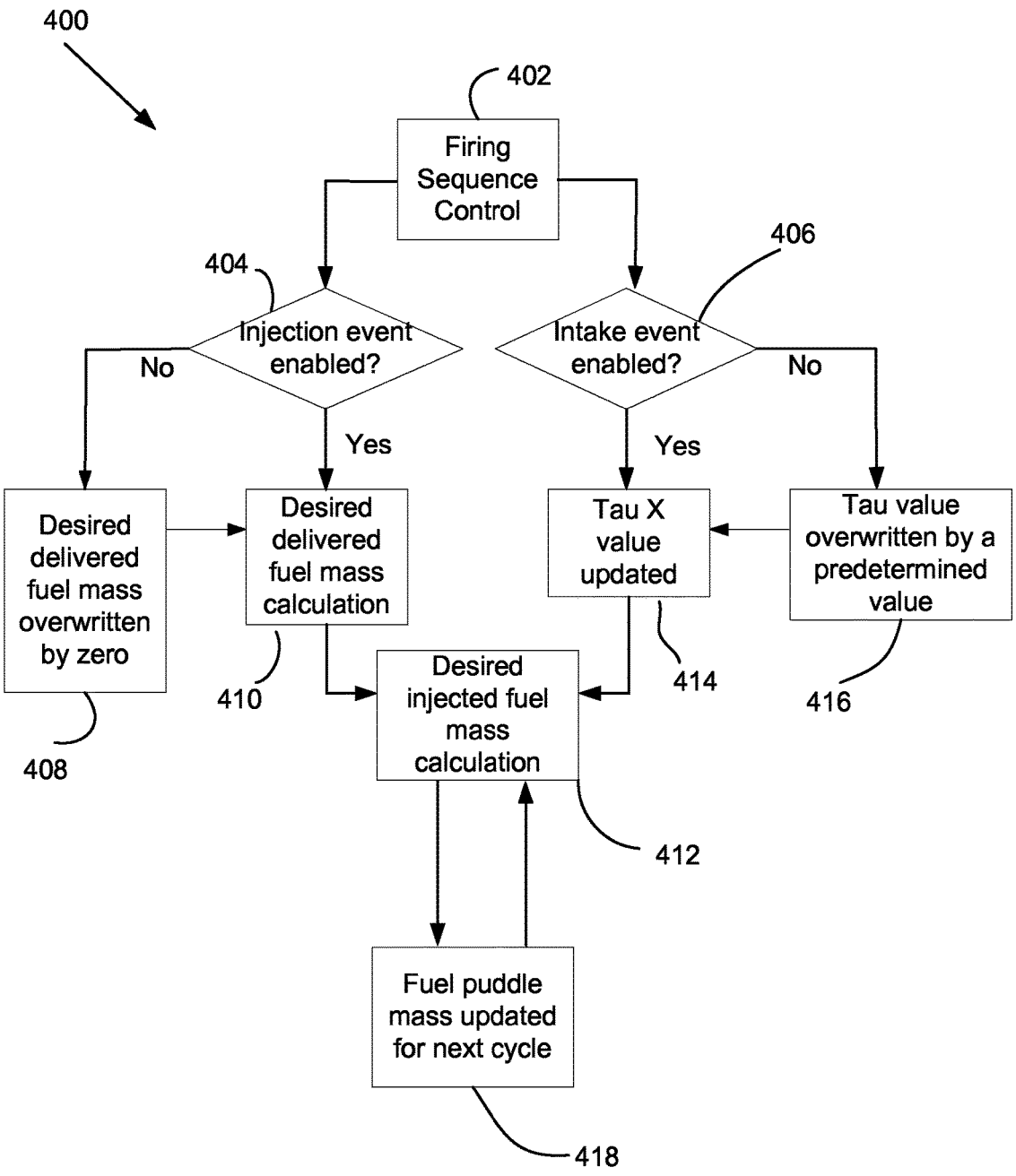
FIG. 4 is a flow diagram illustrating a method for determining fuel puddle compensation values according to a particular embodiment of the present invention.

Referring next to FIG. 4, a flow diagram illustrated a method 400 for determining a desired injected fuel mass according to another embodiment of the present invention will be described. The illustrated embodiment relates to the calculation of Tau and X values. As is known in the art, Tau and X generally relate to the deposition of fuel on a port in a port injection engine. More specifically, in port injection engines, fuel is delivered into a working chamber via a port that leads from an intake manifold to the working chamber. It is often presumed that a fraction of the delivered fuel, rather than reaching the working chamber directly, instead is deposited on a surface of the port and forms what is commonly referred to as a puddle. X should be understood as any value that helps indicate the fraction of the injected fuel that is deposited in this manner. It is also assumed that the puddle decays into the working chamber over time. Tau should be understood as any value that helps indicate a rate of this decay. There may also be a running estimate of the mass of the puddle, which changes over time depending on Tau and X. Tau, X and the puddle mass are then taken into account when calculating the total amount of fuel mass that should be injected. A more accurate fuel mass estimate can help improve fuel efficiency and reduce undesirable pollutants in the exhaust.

For optimal performance, it is believed that conventional Tau-X models should be modified for skip fire applications. In a conventional, non-skip fire engine control system, each working chamber is typically fired during every engine cycle. As a result, a conventional Tau-X model assumes fairly consistent Tau-X values over multiple working cycles. However, in a skip fire engine approach, a particular working chamber may have a mixed sequence of fires and skips that may change from working cycle to working cycle. That is, fuel injection events or intake events for a working chamber do not take place during every working cycle. The present invention contemplates a modified fuel puddle model that takes into account the distinct firing history of each working chamber. In some applications, for example, if there is a skip and no intake event during a working cycle of a particular working chamber, it may be desirable to set Tau to a lower value or zero for that working cycle, because it is assumed that there is little or no transfer of fuel from the puddle into the working chamber.

It should be appreciated that the described embodiments are not limited to the conventional Tau-X model and that the described embodiments may be applied to any suitable model used to compensate for puddle dynamics. The present application further contemplates models that take into account factors or variables that are generally not addressed in a traditional Tau-X model. Consider a puddle that has formed on the port for a particular working chamber. Conventional Tau-X models do not take into account the possibility that fuel may move from the puddle into other working chambers. The described embodiments may be modified to take into account such factors.

Referring again to FIG. 4, the flow diagram illustrates one example technique for determining a desired injected fuel mass using Tau-X values. At step 402 a skip fire firing sequence is generated. The firing sequence includes a series of firing commands that each indicate how a selected working chamber should be operated (e.g., skipped or fired.) The firing sequence may be generated in any suitable manner. For example, the aforementioned co-assigned patent applications describe a variety of mechanisms (ECUs, engine controllers, firing timing determination modules, sigma delta converters, etc.) that can be used to generate a suitable skip fire firing sequence.

At step 404, it is determined whether a selected firing command, which is used to operate a selected working chamber during a selected working cycle, would involve a fuel injection event. If so, a value is determined that indicates a desired fuel mass for the working chamber (step 410). This calculation may be performed in any suitable manner that is known in the art or described in the aforementioned co-assigned patent applications. If there is no injection event (e.g., in a case where the working chamber is skipped and there is no combustion), then the value for the desired delivered fuel mass is set to zero (steps 408 and 410).

At step 406, a determination is also made as to whether the selected firing command involves an intake event. If an intake event is involved, the Tau-X values are updated (step 414). Any suitable method known in the art may be used to calculate or update the Tau-X values. If an intake event is not involved, then the Tau value is set to zero or a suitable predetermined value (step 416.) In some embodiments, for example, there is a predetermined value that represents the evaporation rate that applies for a puddle in the event of a skip of a corresponding working chamber. In step 416, the Tau value may be set to this evaporation rate.

At step 412, a desired amount of fuel to be injected into the working chamber is calculated. The calculation is based at least in part on the Tau-X and desired fuel mass values calculated in steps 410 and 414. Any value representing a puddle mass estimation (e.g., from earlier iterations of method 400) is updated using the Tau-X values (step 418). The update may depend on whether there was an injection event. In the illustrated embodiment, for example, if there was no injection event, it is assumed that there is no addition to the puddle mass, since no additional fuel was injected or deposited on the port. The updated puddle mass is then used when method 400 is repeated for another working cycle.

Figure 5:
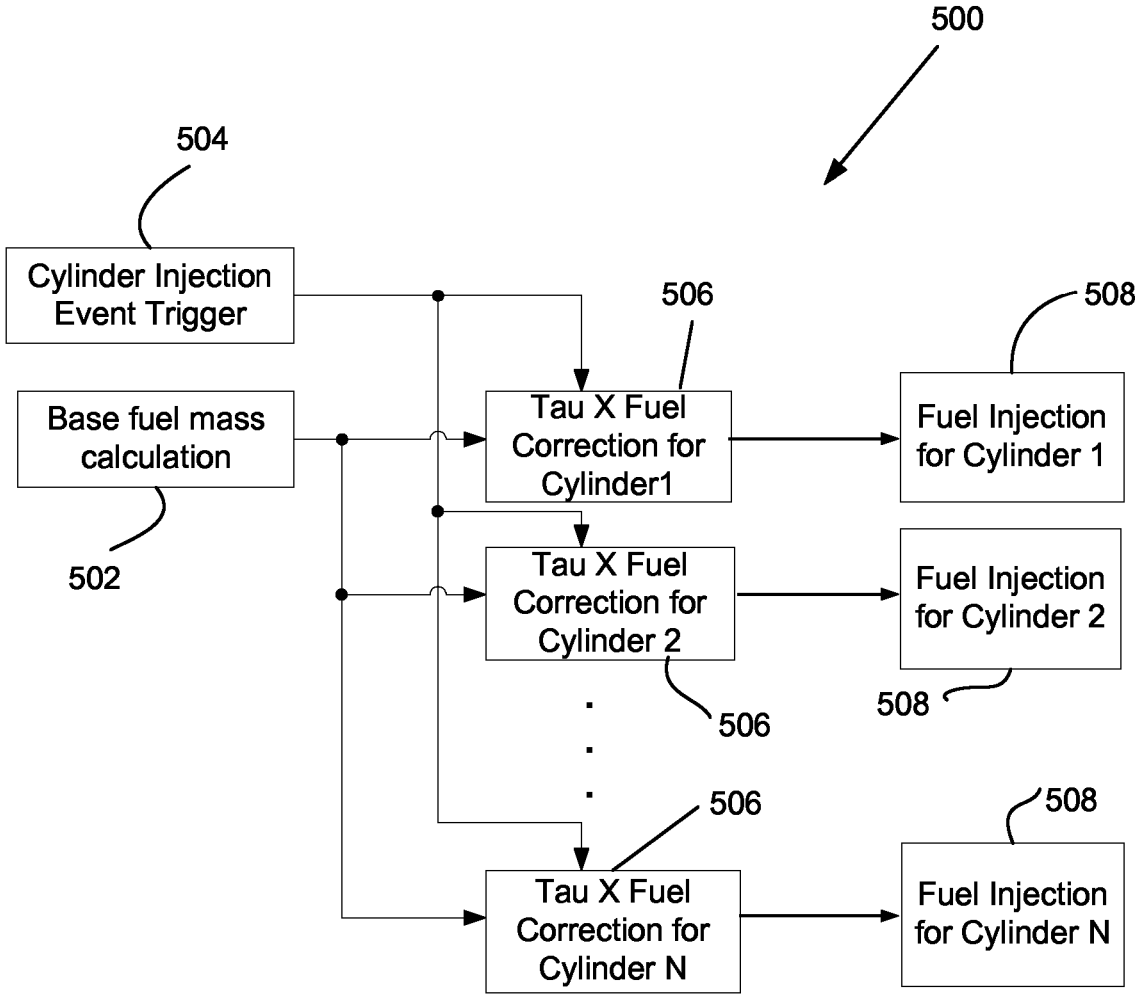
FIG. 5 is a flow diagram illustrating a method for generating distinct fuel puddle compensation values for multiple cylinders according to a particular embodiment of the present invention.

Referring next to FIG. 5, an example method 500 for performing injected fuel mass calculations for multiple working chambers will be described. While FIG. 4 describes a process for generating an injected fuel mass calculation for a single working chamber during a selected working cycle, FIG. 5 indicates how the process may be performed independently for multiple working chambers. In this particular example, distinct Tau-X and injected fuel mass calculations are made for each of cylinders 1 through N.

At step 502, a base fuel mass calculation is made. (For example, step 502 of FIG. 5 may correspond to step 410 of FIG. 4.) Additionally, it is determined independently for each working chamber whether an injection event will take place during the selected working cycle (step 504 of FIG. 5 and step 404 of FIG. 4). For each working chamber, a correction for the base fuel mass calculation of step 502 is performed (step 506) based on calculated Tau and X values (e.g., as previously discussed in connection with step 412 of FIG. 4.) At step 508, the corrected base fuel calculation is used to determine the amount of fuel to inject into the corresponding working chamber. (This step corresponds to step 412 of FIG. 4) Since each working chamber may have a different firing pattern involving different sequences of skips, fires, intake or injection events, each working chamber may have distinct Tau and X values and different fuel injection amounts, even during the same engine cycle. Selected amounts of fuel are then injected for each working chamber based on the aforementioned calculations (step 508).

It should be appreciated that the operations and parameters used to calculate Tau, X and the desired injected fuel mass may vary widely, depending on the needs of a particular application. By way of example, the present invention also contemplates Tau-X models in which it is assumed that fuel still evaporates from the fuel puddle, even when there is no intake event. In some implementations, Tau is therefore non-zero under such conditions and/or is lower than it would be if there was an intake event. The rate of evaporation may depend on a variety of factors, such as intake manifold conditions (e.g., manifold absolute pressure, manifold temperature, etc.), the number of working chambers fired, etc.

Although the figures of the application illustrate various distinct modules and submodules, it should be appreciated that in other implementations, any of these modules may be combined or rearranged as appropriate. The functionality of the illustrated modules may also be incorporated into modules described in the aforementioned co-assigned patent applications. For example, some of these patent applications refer to an engine control unit (ECU). Various implementations contemplate incorporating any of the described engine controllers into the ECU. Additionally, it should be understood that any of the features or functions described in the prior co-assigned patent applications may be incorporated into the embodiments described herein.

The described embodiments work well with skip fire engine operation. Skip fire engine operation generally involves directing firings such that at least one selected working cycle of at least one selected working chamber is deactivated and at least one selected working cycle of at least one selected working chamber is fired. Individual working chambers are sometimes deactivated and sometimes fired. In some embodiments, working chambers are fired under close to optimal conditions. That is, the throttle may be kept substantially open and/or held at a substantially fixed positioned even through some variations in a desired torque output. In some embodiments, during the firing of working chambers the throttle is positioned to maintain a manifold absolute pressure greater than 70, 80, 90 or 95 kPa.

The invention has been described primarily in the context of controlling the firing of 4-stroke piston engines suitable for use in motor vehicles. However, it should be appreciated that the described skip fire approaches are very well suited for use in a wide variety of internal combustion engines. These include engines for virtually any type of vehicle—including cars, trucks, boats, construction equipment, aircraft, motorcycles, scooters, etc.; and virtually any other application that involves the firing of working chambers and utilizes an internal combustion engine. The various described approaches work with engines that operate under a wide variety of different thermodynamic cycles—including virtually any type of two stroke piston engines, diesel engines, Otto cycle engines, Dual cycle engines, Miller cycle engines, Atkinson cycle engines, Wankel engines and other types of rotary engines, mixed cycle engines (such as dual Otto and diesel engines), radial engines, etc. It is also believed that the described approaches will work well with newly developed internal combustion engines regardless of whether they operate utilizing currently known, or later developed thermodynamic cycles. The described embodiments can be adjusted to work with engines having equally or unequally sized working chambers.

Although only a few embodiments of the invention have been described in detail, it should be appreciated that the invention may be implemented in many other forms without departing from the spirit or scope of the invention. The illustrated embodiments sometimes describe specific operations and values to be used in various calculations. It should be understood that the present invention also contemplates approaches in which the described embodiments are modified to use different operations, inputs, calculation methods and values. In some embodiments and in the claims, there is a discussion of X and Tau. However, it should be appreciated that the embodiments should not be limited to conventional definitions or uses of X and Tau, and X and Tau may be understood to mean any suitable values relating to an amount or fraction of fuel deposited to form a puddle and a decay rate of the puddle, respectively. Therefore, the present embodiments should be considered illustrative and not restrictive and the invention is not to be limited to the details given herein.

What is claimed is:

1. An engine controller for an internal combustion engine operated in a skip fire manner, the engine having a plurality of working chambers, the engine controller comprising:

a firing counter that stores a firing history indicating a number of skips for a working chamber in the engine; and a combustion control module that is arranged to determine a combustion control parameter used in the control of an actuator to help manage combustion in the working chamber during the next fired working cycle that occurs in the working chamber, and wherein the determination of the combustion control parameter is based at least in part on the firing history.

2. An engine controller as recited in claim 1 wherein the combustion control parameter is selected from the group consisting of injection timing, injection pulse width, fuel pressure, ignition dwell time, valve lift and cam phasing.

3. An engine controller as recited in claim 1 wherein the firing history indicates at least one selected from the group consisting of 1) a number of consecutive skips since a fire; 2) a number of skips over a plurality of consecutive working cycles of the working chamber; and 3) a number of fires and skips over a plurality of consecutive working cycles of the working chamber.

4. An engine controller as recited in claim 1 wherein:

the firing counter is arranged to store a plurality of firing histories for an associated plurality of working chambers, respectively, each firing history indicating a number of skips for one of the associated working chambers; and the firing counter is arranged to store a distinct firing history for each working chamber.

5. An engine controller as recited in claim 4 wherein the firing histories indicate that the working chambers were operated in a skip fire manner such that selected working cycles of selected working chambers are skipped and selected working cycles of selected working chambers are fired and wherein individual working chambers are sometimes skipped and sometimes fired.

6. An engine controller as recited in claim 1 wherein:

the combustion control module is arranged to apply a model that determines puddle dynamics of a puddle that forms on an intake port of the working chamber wherein the model takes into account the firing history and is used to help determine the combustion control parameters.

7. An engine controller as recited in claim 6 wherein the combustion control module is arranged to help determine an amount of fuel to deliver to the working chamber based on a calculation of X and Tau, X representing a fraction of injected fuel that forms a puddle on an intake port for the working chamber and Tau indicating a rate of decay of the deposited fuel into the working chamber.

8. An engine controller as recited in claim 7 wherein the combustion control module is further arranged to assign a first value to Tau if there was an intake event during a selected working cycle of the working chamber and to assign a second, different value to Tau if there was no intake event during the selected working cycle.

9. An engine controller as recited in claim 7 wherein the combustion control module is further arranged to calculate the fuel delivery amount, X and Tau independently for each of the plurality of working chambers.

10. An engine controller as recited in claim 1 wherein the calculation of the amount of fuel to deliver to the working chamber is further based on one of the group consisting of 1) engine temperature; 2) manifold absolute pressure; 3) air charge; 4) cam timing; and 5) firing histories of other working chambers in the plurality of working chambers.

11. An engine controller as recited in claim 1 wherein when the firing history indicates more skips, the combustion control module is arranged to selectively perform one selected from the group consisting of: 1) increase the amount of fuel delivered to the working chamber; and 2) decrease the amount of fuel delivered to the working chamber based on the firing history.

12. An engine controller as recited in claim 1 wherein when the firing history indicates more skips, the combustion control module is arranged to perform one selected from the group consisting of: 1) further advance spark timing based on the firing history; and 2) further retard spark timing.

13. An engine controller as recited in claim 1 wherein the firing history includes a parameter that helps indicate at least one selected from the group consisting of: 1) whether the working chamber was fired or skipped; and 2) conditions under which the working chamber was fired or skipped.

14. A method for manipulating a combustion control parameter for a working chamber of an engine during skip fire operation of the engine, the method comprising:

storing a firing history indicating a number of skips for the working chamber;

determining a combustion control parameter that is used to help manage combustion in the working chamber wherein the determination of the combustion control parameter is based at least in part on the firing history; and utilizing the combustion control parameter in the control of an actuator that impacts the combustion in the working chamber during a next fired working cycle of the working chamber.

15. A method as recited in claim 14 wherein the combustion control parameter is selected from the group consisting of injection timing, injection pulse width, fuel pressure, ignition dwell time, valve lift and cam phasing.

16. A method as recited in claim 14 wherein the firing history indicates at least one selected from the group consisting of 1) a number of consecutive skips since a fire; 2) a number of skips over a number of consecutive working cycles of the working chamber; and 3) a number of fires and skips over a plurality of consecutive working cycles of the working chamber.

17. A method as recited in claim 14 further comprising:

storing a plurality of firing histories for an associated plurality of working chambers, respectively, each firing history indicating a number of skips for one of the associated working chambers; and storing a distinct firing history for each working chamber.

18. A method as recited in claim 14 wherein the firing histories indicate that the working chambers were operated in a skip fire manner such that selected working cycles of selected working chambers are skipped and selected working cycles of selected working chambers are fired and wherein individual working chambers are sometimes skipped and sometimes fired.

19. A method as recited in claim 14 further comprising:

determining an amount of fuel to deliver to the working chamber based on a fuel puddle model calculation of X and Tau, X representing a fraction of injected fuel that forms a puddle on an intake port for the working chamber and Tau indicating a rate of decay of the deposited fuel into the working chamber.

20. A method as recited in claim 19 further comprising:

assigning a first value to Tau if there was an intake event during a selected working cycle of the working chamber and assigning a second, different value to Tau if there was no intake event during the selected working cycle.

21. A method as recited in claim 19 further comprising:

calculating the fuel delivery amount, X and Tau independently for each of the plurality of working chambers.

22. A method as recited in claim 14 further comprising:

selectively adjusting the amount of fuel delivered to the working chamber based on the firing history wherein the firing history indicates a sequence of skips and fires.

23. An engine controller as recited in claim 1 wherein the firing history is a history of fires and skips for the working chamber.

24. An engine controller as recited in claim 1 wherein the firing history indicates a number of skips for a sequence of one or more successive firing opportunities for the working chamber wherein a next firing opportunity for the working chamber involves the combustion that is to be managed using the determined combustion control parameter.

25. An engine controller as recited in claim 1 further comprising:

a firing timing determination module arranged to determine one or more firing decisions that indicate whether the working chamber is fired or skipped during first and second firing opportunities and wherein the firing timing determination module further determines that the working chamber is fired during the second firing opportunity and wherein:

the firing history is based on the one or more firing decisions determined by the firing timing determination module; and the combustion control parameter is used to help manage combustion in the working chamber during the second firing opportunity.

26. An engine controller as recited in claim 1 wherein the firing history indicates a number of fires and skips for at least two firing opportunities for the working chamber.

27. An engine controller for an internal combustion engine operated in a skip fire manner, the engine having a plurality of working chambers including first and second working chambers, the engine controller comprising:

a firing counter that stores a firing history indicating a number of skips for the first working chamber in the engine; and a combustion control module that is arranged to determine a combustion control parameter used in the control of an actuator to help manage combustion in the second working chamber during the next fired working cycle that occurs in the second working chamber, and wherein the determination of the combustion control parameter is based at least in part on the firing history for the first working chamber.

28. An engine controller as recited in claim 27 wherein the firing history indicates whether a fire or skip occurred in a firing opportunity that immediately precedes another firing opportunity in which the combustion takes place.

* * * * *